US006199854B1

(12) United States Patent
Tranquilla et al.

(10) Patent No.: US 6,199,854 B1
(45) Date of Patent: Mar. 13, 2001

(54) DOCUMENT FEEDER WITH VARIABLE-SPEED SEPARATOR

(75) Inventors: Michael N. Tranquilla, Livonia; J. Michael Spall, Plymouth, both of MI (US)

(73) Assignee: Unisys Corporation, Blue Bell, PA (US)

( * ) Notice: Subject to any disclaimer, the term of this patent is extended or adjusted under 35 U.S.C. 154(b) by 0 days.

(21) Appl. No.: 09/152,501

(22) Filed: Sep. 1, 1998

Related U.S. Application Data

(60) Provisional application No. 60/058,724, filed on Sep. 12, 1997.

(51) Int. Cl.[7] ..... B65H 3/04; B65H 3/52

(52) U.S. Cl. ..... 271/34; 271/121; 271/122

(58) Field of Search ..... 271/3.17, 4.03, 271/10.02, 10.03, 10.06, 110, 111, 121, 34, 122, 124, 125, 104

(56) References Cited

U.S. PATENT DOCUMENTS 3,894,732 * 7/1975 Muller ..... 271/34
5,192,068 * 3/1993 Parker et al. ..... 271/34
5,386,984 * 2/1995 Toso et al. ..... 271/122
5,443,359 * 8/1995 Miller et al. ..... 271/125
5,664,771 * 9/1997 Nagatani et al. ..... 271/10.03

FOREIGN PATENT DOCUMENTS

591897 * 2/1960 (CA) ..... 271/34
0196424 * 8/1988 (JP) ..... 271/34
0028133 * 1/1989 (JP) ..... 271/111

* cited by examiner

*Primary Examiner*—H. Grant Skaggs
(74) *Attorney, Agent, or Firm*—David G. Rasmussen; Mark T. Starr; Lise A. Rode

(57) ABSTRACT

A machine for processing documents has a document feeder adapted to selectively adjust document feed rate and inter-document separation. The document feeder has a feeder surface for feeding documents into the machine. There is a nip between the feeder surface and a separator surface. The end document of a stack is urged, singly into the nip and advanced therebeyond by the feeder surface. The separator surface restrains the remaining documents of the stack. A control adjusts the speed of the separator surface to be continuously variable and independent of the speed of said feeder surface, with the separator surface speed adjusted to optimize the document feed rate, optimize interdocument separation, and minimize damage to the documents being fed into the machine.

25 Claims, 7 Drawing Sheets

VIEW FROM SEPARATOR BELT
WHERE IT CONTACTS FEEDER TIRE

DOCUMENT FEEDER WITH VARIABLE-SPEED SEPARATOR

This is a Continuation of our U.S. Provisional filing on Sep. 12, 1997, U.S. Ser. No. 60/058,724 and claims priority therefrom.

This relates to systems for feeding and transporting items (e.g., documents), and particularly to such where a separator means is provided and controlled to vary its action according to the condition/movement of the items and related transport means.

BACKGROUND, FEATURES

Workers in the item-transport (e.g., document-transport arts are aware of the need for better means to feed items from a pack and to separate items behind the foremost item in the pack (i.e. "following items").

For instance, workers recognize how documents feeders co-act with document separators to feed documents singly, in order, from a pack (input hopper). It is assumed that a document feeder is a device for separating one document from a stack (pack) thereof and feeding it to another device, such as a document transport. This invention contemplates using a separator belt (or roll) in conjunction with the document feed wheel and controllably varying the speeds of each (belt/wheel) to produce optimal document advancement at a variety of feed rates. Furthermore, the speed of such a separator belt (or roll) is taught as being varied without varying the feed wheel speed, to thus optimize feeder performance for a variety of document types and/or document conditions.

Purpose

Our purpose is to minimize document "feed errors", and feeder jams, and to maximize throughput, doing so with a document feeder (fixed or variable speed). Document "feed errors" can be: feeding two or more documents at once, feeding documents overlapped, or feeding documents too close together.

Salient Novel Features

The speed of such a separator belt can be varied to maintain optimal document feeder performance when the speed of the associated feedwheel is changed. Also, for document feeders with fixed feedwheel speed, separator belt speed can be changed to optimize feeder performance for a variety of document conditions and document types. Fundamentally, the separator speed is adjusted to be more closely related to the velocity of document leading edges in the "wedge" that is formed just upstream of the feedwheel/separator nip. Depending upon document conditions, this speed may be varied above or below a nominal value to optimize feeding reliability. Since some document processing equipment may require various feed rates from the feeder because of various downstream processing options, separator speed can be varied in accordance with feedwheel speed and to maintain a reliable, constant document feed.

Advantages

More conventional separator belts (or rolls) run at a constant speed, primarily so as to distribute wear, or to present fresh, new belt material to the feedwheel/separator nip and so maximize separation friction. Also, some separator belts (or rolls) may be stationary, requiring frequent replacement because of wear or contamination from documents.

A system according to this invention can thus be set up to adapt a separator to adjust to changes in feed rate, documents, etc. Also, various electrical utilization circuits can control the feeder and separator together, and adjust for document/machine conditions.

This invention takes advantage of elements that already exist and adapts them to shifting conditions in document-feed. Worker will realize that this invention can be used for document sorters, mail sorter, copiers, page feeders, punch card pickers and transports, envelope stuffing machines, money feeders, fax machines and automatic teller machines.

Thus, an object hereof is to alleviate at least some of the foregoing problems and effect at least some of the foregoing advantages and results. A related object is to do so for an item feeder/separator arrangement used to advance documents or the like from a pack.

BRIEF DESCRIPTION OF THE DRAWINGS

These and other features and advantages of the present invention will be appreciated by workers as they become better understood by reference to the following detailed description of the present preferred embodiments which should be considered in conjunction with the accompanying drawings, wherein like reference symbols denote like elements.

DETAILS OF PREFERRED EMBODIMENTS

The methods and means discussed herein will generally be understood as constructed and operating as presently known in the art, except where otherwise specified; likewise all materials, methods, devices and apparatus described herein will be understood as implemented by known expedients according to present good practice.

Figure 1:
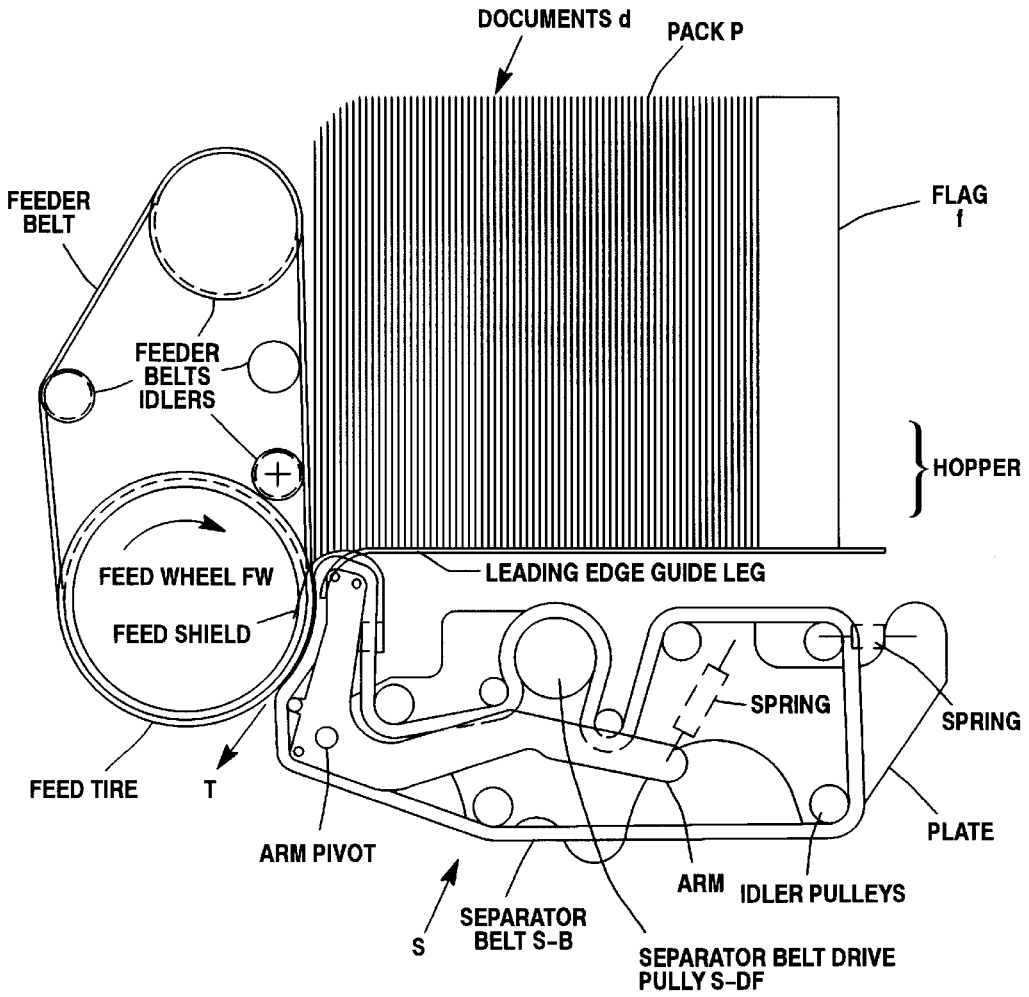
FIG. 1 is a side view of schematic idealized document feeder/separator configuration apt for embodying this invention.

Referring to FIG. 1, it is assumed that documents are to be transported down a track T (see arrow) by transport means known to those familiar with the state of the art. This invention will work with any number of these transport systems: e.g., with rollers, belts, vacuum belts, electrostatic belts, etc., and combinations of these. Systems that don't already have idler pinch rollers (such as vacuum belts), can still have idler pinch rollers added.

In FIG. 1, workers will recognize that a document feeder unit F consists of a feeder belt (tire) FB to nudge documents between a feeder wheel FW and an associated separator unit S (see belt S-B), the feeder wheel to accelerate documents up to transport speed, and the separator belt to hold back documents not intended to be fed. Feeder wheel FW rotates clockwise. The separator belt S-B may rotate clockwise or counterclockwise and is adapted to distribute wear uniformly along the entire belt length. If the separator belt also rotates in same direction as FB, it is at a much slower speed than the feed belt, primarily to prevent the separator belt (S-B) from pushing too many documents (too rapidly) into the feeder/separator nip (where FB meets S-B). Some feeders may have a separator roller rather a belt, but the same principles apply. Additionally some feeders may have a stationary object to provide a retard force that prevents 2nd, 3rd, etc., documents from being fed with, or before, the 1st (in line, in pack P). These devices are commonly known to those familiar with the state of the art of document feeders.

Figure 2:
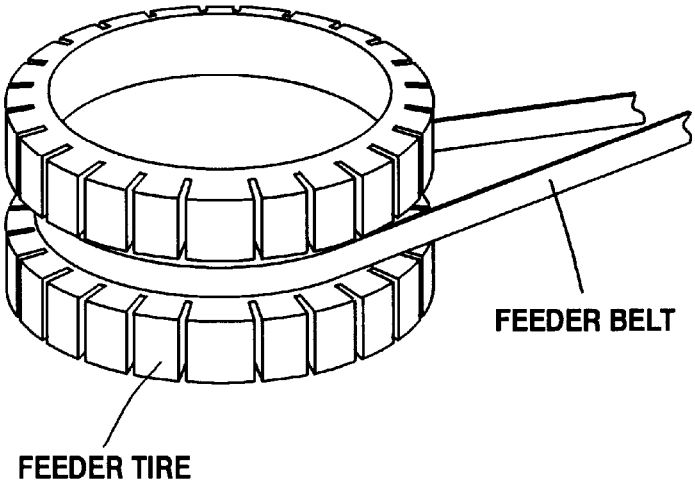
FIG. 2 is a side perspective of a feed tire/belt apt for use in such.

A feed tire F-T is attached to feedwheel FW which is driven by a motor M (not shown here). Separator belt S-B is driven by a drive pulley S-DP which is also driven by motive means. These two motive means are synchronized together (electrically or via other means—e.g. see FIG. 8) to start and stop together. This prevents the separator from feeding documents when the feeder is stopped. The feeder belt is driven by the feed tire as illustrated in FIGS. 1, 2. But it is not necessary for the feeder belt to be driven by the feed tire for purposes of this invention; it may be driven by other means as is well known in the art.

Figure 3:
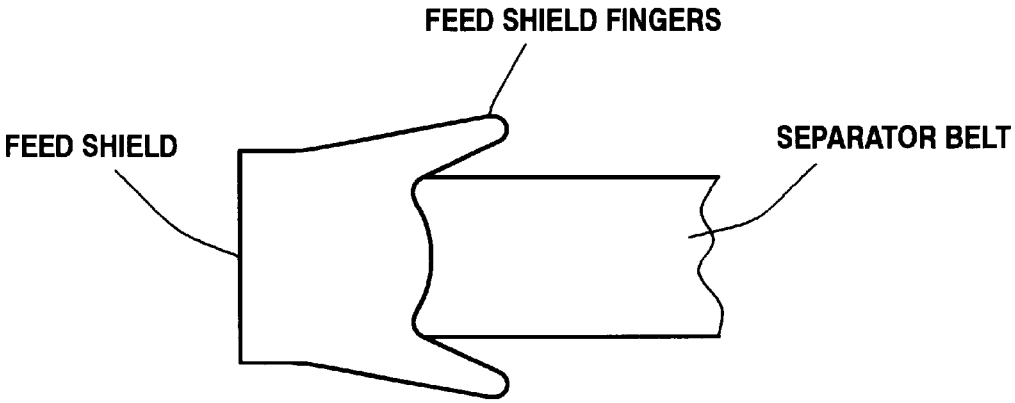
FIG. 3 is a very schematic side view of a related "feed shield"
Figure 6:
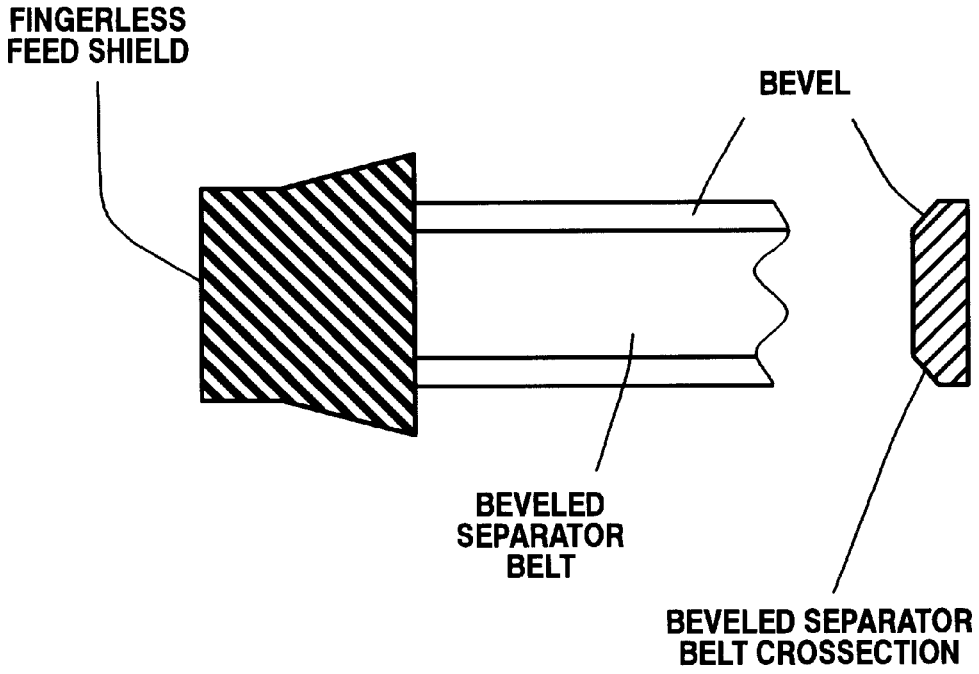
FIG. 6 is a view as in FIG. 3 of a different shield/bevel separator belt embodiment.

A feed shield F-S may preferably be provided in the vicinity of the feed wheel/separator nip as shown in FIG. 1. Another view of the feed shield is shown in FIG. 3. The feed shield F-S has fingers F-Sf to deflect document leading edges away from the corners of the separator belt. Often, separator belts are made of cellular foam which may tangle these leading edges at the belt's corners and prevent the feed tire/belt from successfully feeding them. However, the construction of these shield fingers, typically thin flexible steel, may effectively reduce the retardation force of the separator belt, because of the low friction of the steel against paper documents and by urging/forcing the documents away from the separator. (which can result in multiple or overlapped documents being fed) A solution to this problem is a beveled separator belt and a "fingerless feed shield" F-SS, as illustrated in FIG. 6.

In FIG. 1, the document stack hopper consists of a document leading edge guide wall LEG, a floor (not shown) to support the bottom edge of documents d, and a movable flag f to apply force to one end of the document stack.

The flag force produces a reaction force at the other distal end of the stack from where the document stack contacts the feeder belt FB. This reaction force produces a "stack friction" force between the (foremost) document that is being fed and the following document. The feed tire (and feeder belt) must accelerate the document against this stack friction force. The guidance of the flag, the means of applying the flag force, and the document hopper may be constructed as known to those practiced in the arts of such document feeding.

Figure 4:
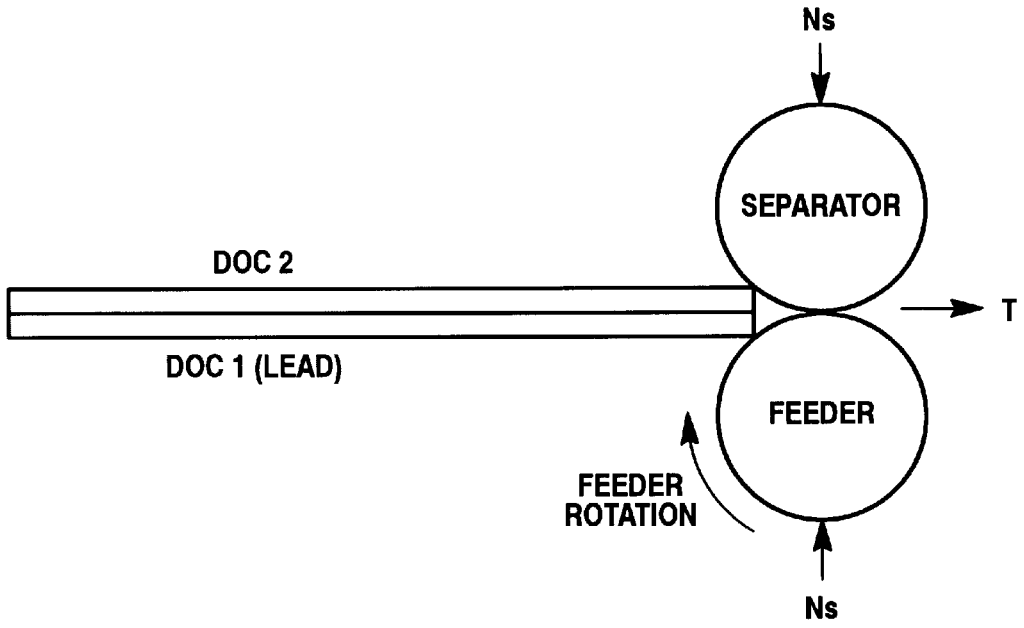
FIG. 4 is a like view two documents to be fed by such.

FIG. 4 shows a simplified view to illustrate document feeding separation. The feeder (also known as the feed tire and/or feed belt) drags document 1 through the feeder/separator nip because the friction between the feeder and document 1 is higher than the friction between documents 1 and 2. The separator separates document 2 from document 1 because the friction between the separator and document 2 is greater than the friction between documents 1 and 2. Doc 1 thus advances because the separator/doc2 friction is smaller than the feeder/doc1 (drive) friction. In this way, the separator retards document 2 (and subsequent following documents) from being fed by the feeder, while allowing lead-document 1 to feed. In this illustration, the separator is stationary, but it can also perform its functions if it is moving (e.g. in same direction, but much more slowly than the feeder).

The feeder described in FIG. 1 removes one document at a time from the document stack in the hopper and feeds it to a document transport, usually consisting of a series of roller pairs or belts that convey the document past other processing devices such as readers, printers, images, sorters, etc. These downstream processing devices require that the documents not be overlapped and further, that they have sufficient space (gap) between them. Such space may be required so that they may be routed along different paths with gates that operate in (during) the related interdocument interval, e.g. image data collected from a document can be transmitted (during) this space-time, etc. A feeder's performance is judged by the (low) incidence of double or overlapped documents fed, by the consistency of document spacing, and by the (low) incidence of failing to feed or of jamming documents.

Document processors may have devices that require various, different interdocument spaces to perform adequately. These devices aren't always used simultaneously. For example, encoding (printing with magnetic ink) amount fields on checks requires a great deal of interdocument space (time) to prevent following documents from crashing, because the document must be stopped while the code-printing occurs. However, on subsequent passes of these encoded documents, the document processor requires a high feed rate (attained by smaller interdocument spacing) for reading and sorting these documents at higher throughputs. The various feed rates can be obtained by varying the speed of the feed wheel and separator (e.g. see FIG. 1). The purpose and methods of obtaining various feed rates is understood in the art.

Figure 5:
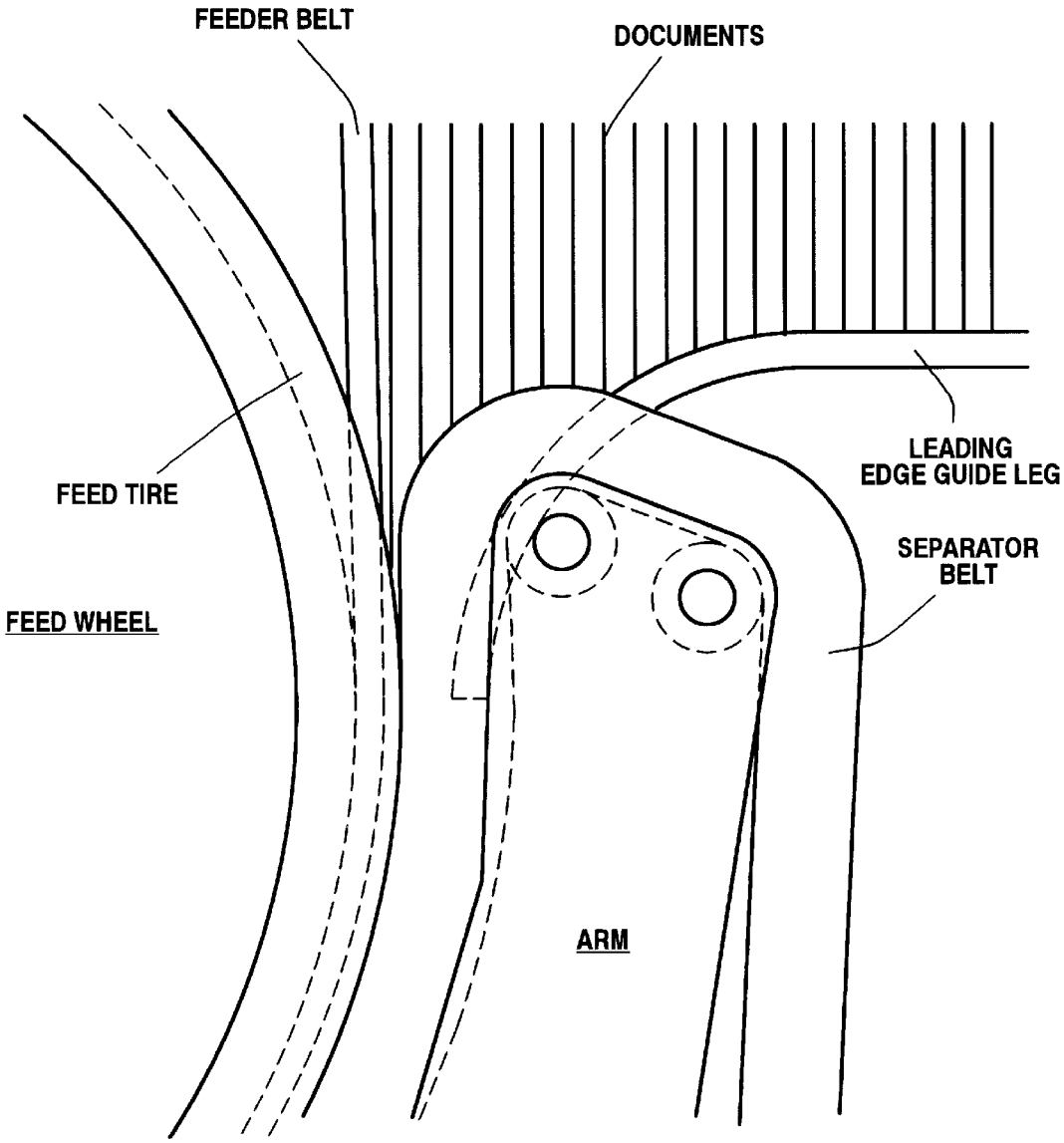
FIG. 5 is a like top view thereof.

Commonly, systems that change the speed of the feed wheel to change feed rate do not correspondingly change the speed of the separator belt in relation to the feed wheel. For a wide range of feed rates (e.g.: 500 documents per minute to 1000 documents per minute), failure to change the separator belt speed may cause feed reliability problems. This invention adjusts the speed on the separator belt in accordance with the speed of the feed wheel to give a more reliable document feed. FIG. 5 is an enlarged, more detailed view of the nip in FIG. 1 (e.g. see feed belt FB, separator belt S-B). Furthermore, since the velocity of leading document edges in the "wedge (between nip, where FB meets S-B, and upstream thereof) is affected by document thickness, the separator belt velocity can by changed—according to this invention—to account for processing of batches of documents of different thickenesses [thicker documents require a slightly slower separator belt velocity than thinner documents]. For example, processing a batch of government checks, usually thick cardstock, requires a lower separator belt velocity than a batch of credit card receipts, usually of very thin paper.

In the kind of feeder described in FIGS. 1–5, a following document (see document 2 FIG. 4) is accelerated to feed wheel speed as soon as the trailing edge of the foremost document (e.g. document 1) leaves the feed/separate nip, and so exposes the leading edge of document 2 to the feed tire. This kind of feeder feeds documents at a rate (in documents per minute) proportional to document length, because the feed wheel is arranged to preferably run at a constant velocity. For longer documents, the feed rate is less than for shorter documents. If a batch of documents is known to include documents of anomalous lengths (i.e. different length than the "nominal" length) the separator belt speed can be changed to accommodate different document lengths and so produce optimal belt velocity closer to the velocity of leading edges in the "wedge". This produces greater feeding reliability for a given batch.

Figure 7:
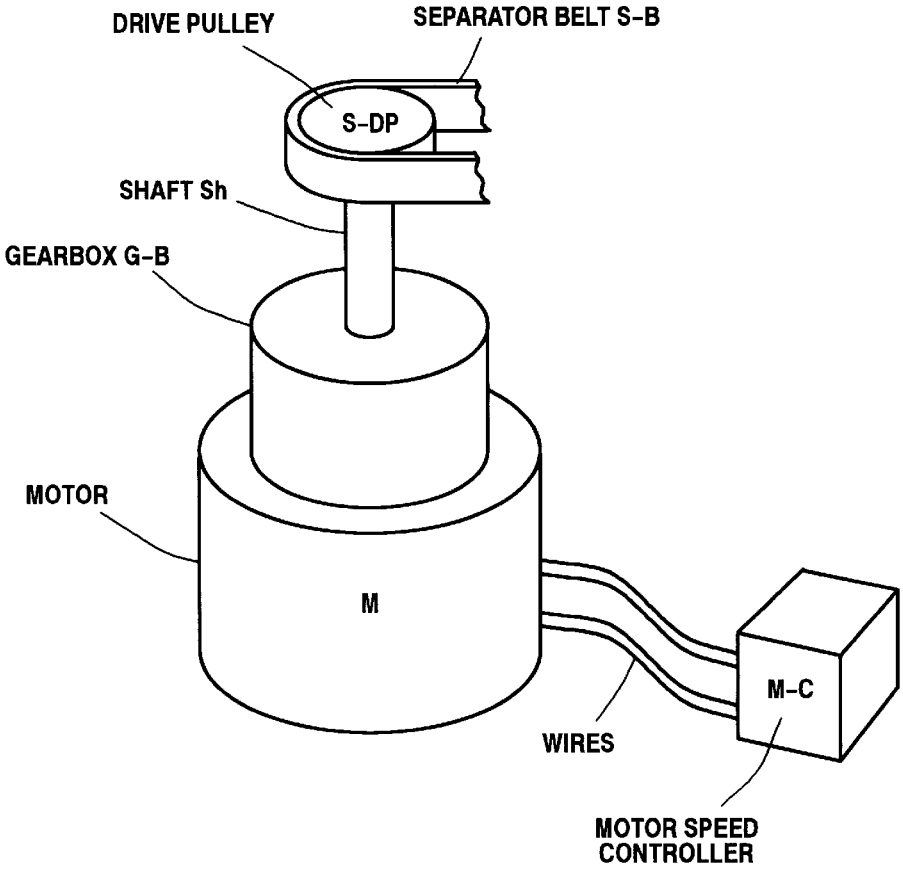
FIG. 7 is a schematic partial view of belt-drive/control elements for such embodiments and FIG. 8 is a block diagram of control logic for such.
Figure 8:
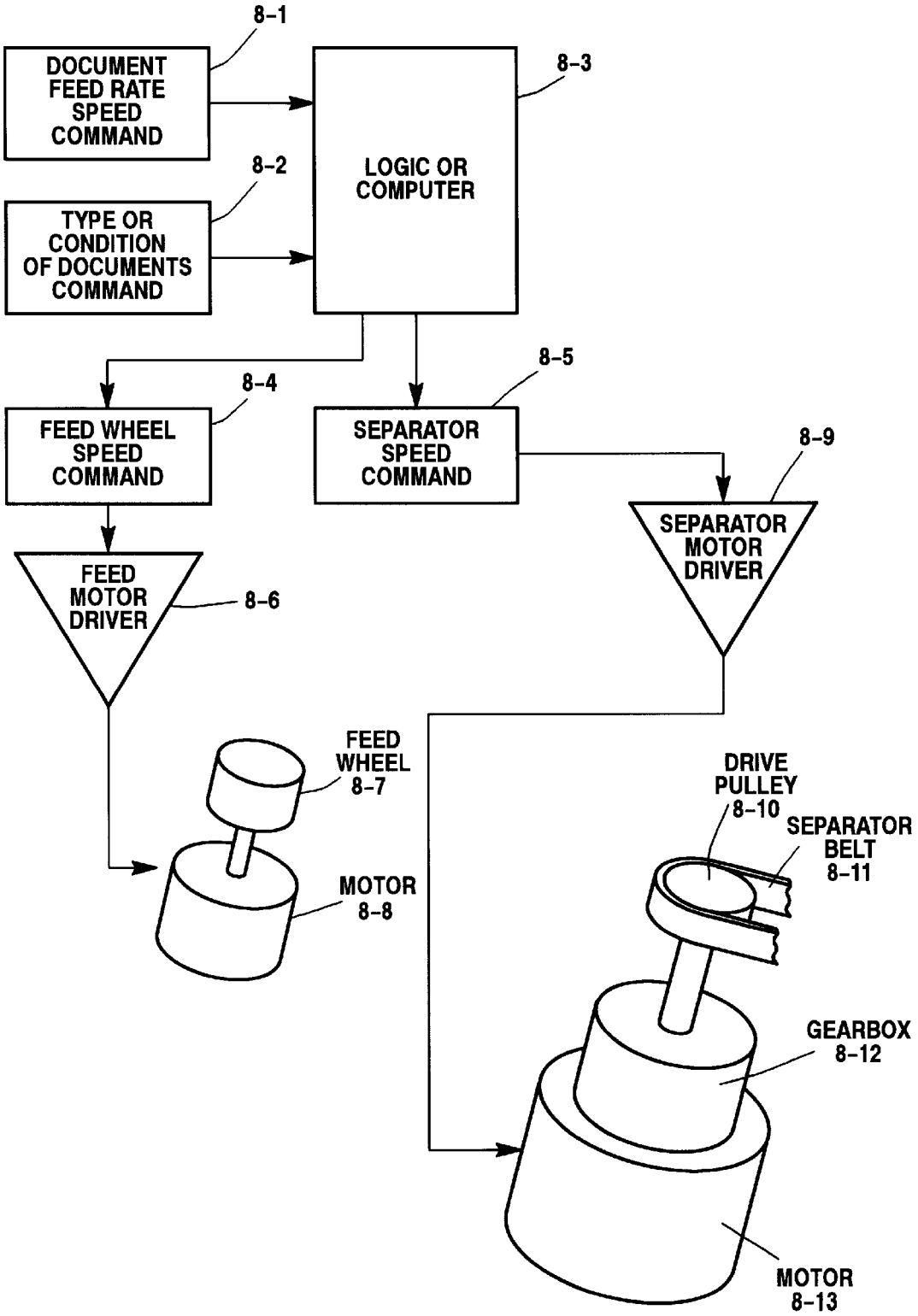

I contemplate various means of producing variable speed of the separator belt. FIGS. 7 and 8 illustrate such means. In FIG. 7, a pulley S-DP drives the separator belt S-B. This pulley is attached to the output shaft Sh of a gearbox GB. The input shaft of the gearbox is driven by a suitable motor M. Such a gearbox can be used to reduce the rotational speed of pulley S-DP, which may typically be too high for driving a separator belt. The (electrical) motor is connected to a motor speed controller unit M-C via electrical wires W, with a motor speed controller M-L operating as known to those practiced in the art of motor speed control.

FIG. 8 depicts, very schematically, a feedwheel 8-7 (driven by associated motor 8-8 controlled by feed control unit 8-6, as known in the art), and an associated separator belt 8-11 (driven by a drive pulley 8-10 which, in turn, is driven by associated motor 8-13, controlled by separator control unit 8-9, as known in the art).

A suitable computer (logic unit) 8-3 is provided to control respective speed command stages 8-4, 8-5, adapted to responsively issue respective appropriate respective speed command signals to each of these control units, 8-6, 8-9. Computer 8-3 does this responsive to use of prescribed software and to receiving input as document-feed commands (e.g. from 8-1) and as document-type/condition input (e.g. from 8-2).

Thus for example as the thickness of hopper documents increases in prescribed fashion, a signal (from 8-2) reflecting this will cause computer 8-3 to prompt command stage 8-5 to make separator motor driver 8-9 to reduce the velocity of separator motor 8-13, and thus of pulley 8-10 and belt 8-11, as workers will appreciate.

Similarly, as document length decreases in prescribed fashion, a signal (from 8-2) reflecting this will cause computer 8-3 to prompt command stage 8-4 to make feed motor driver 8-6 to proportionately reduce the rotational velocity of feed motor 8-8 (and thus of feed wheel 8-7 as workers will understand. Or, other like control arrangements may be substituted, as workers will appreciate, to similarly adjust the speeds of the feed means and the separator means.

In conclusion, it will be understood that the preferred embodiments described herein are only exemplary, and that the invention is capable of many modifications and variations in construction, arrangement and use without departing from the spirit of the claims.

For example, the means and methods disclosed herein are also applicable to other related item-feed transport arrangements. Also, the present invention is applicable for other related separator arrangements.

The above examples of possible variations of the present invention are merely illustrative. Accordingly, the present invention is to be considered as including all possible modifications and variations coming within the scope of the invention as defined by the appended claims.

What is claimed is:

1. A machine for processing documents having a document feeder adapted to selectively adjust document feed rate and interdocument separation, said document feeder comprising:

a feeder surface for feeding documents to said machine, a nip between said feeder surface and a separator surface where the end document of a stack is urged, singly into said nip and advanced therebeyond by said feeder surface, said separator surface restraining the remaining documents of said stack, a control for adjusting the speed of said separator surface to be continuously variable and independent of the speed of said feeder surface, with the separator surface speed adjusted to optimize the document feed rate, optimize interdocument separation, and minimize damage to said documents being fed into said machine.

2. The document feeder of claim 1, in which said control adjusts the speed of said separator surface to be continuously variable in the reverse direction.

3. The document feeder of claim 1, in which said control adjusts the speed of said separator surface to be continuously variable in the forward direction.

4. The document feeder of claim 1, in which said feeder surface speed is variable.

5. The document feeder of claim 4, in which said control adjusts the speed of said separator surface to be continuously variable in the reverse direction.

6. The document feeder of claim 4, in which said control adjusts the speed of said feeder surface to be continuously variable in the forward direction.

7. The document feeder of claim 1, having a document hopper adjacent said separator surface for containing said stack of documents.

8. The document feeder of claim 1, wherein said separator surface is flanked, adjacent said nip, by a shield adapted to deflect document edges away from the edges of the separator surface.

9. The document feeder of claim 8, wherein said shield is adapted to deflect document edges away from the edges of said separator surface by a shaped trailing edge incorporating elongated fingers.

10. The document feeder of claim 1, including a selectively operable separator surface motive element to move said separator surface at selectable times and variable speeds to restrain documents in said stack.

11. The document feeder of claim 10, wherein said control receives a signal indicating the type of said document and controls said separator surface motive element to optimize the document feed rate, optimize interdocument separation, and minimize damage to said documents being fed into said machine.

12. The document feeder of claim 10, wherein said control receives a signal indicating the conditions of said document and controls said separator surface motive element to optimize the document feed rate, optimize interdocument separation, and minimize damage to said documents being fed into said machine.

13. The document feeder of claim 10, wherein said control receives a signal indicating the feed rate, condition and type of said documents and controls said separator surface motive element to optimize the document feed rate, optimize interdocument separation, and minimize damage to said documents being fed into said machine.

14. The document feeder of claim 10, wherein said control receives a signal indicating the thickness of said document and controls said separator surface motive element to optimize the document feed rate, optimize interdocument separation, and minimize damage to said documents being fed into said machine.

15. The document feeder of claim 10, wherein said control receives a signal indicating the length of said document and controls said separator surface motive element to optimize the document feed rate, optimize interdocument separation, and minimize damage to said documents being fed into said machine.

16. The document feeder of claim 10, wherein said control receives a signal indicating the feed rate of said documents and controls said separator surface motive element to optimize the document feed rate, optimize interdocument separation, and minimize damage to said documents being fed into said machine.

17. The document feeder of claim 10, including a selectively operable feed surface motive element to move said feeder surface at selectable times and variable speeds.

18. The document feeder of claim 17, wherein said control receives a signal indicating the type of said document and controls said separator surface motive element and said feed surface motive element to optimize the document feed rate, optimize interdocument separation, and minimize damage to said documents being fed into said machine.

19. The document feeder of claim 17, wherein said control receives a signal indicating the conditions of said document and controls said separator surface motive element and said feed surface motive element to optimize the document feed rate, optimize interdocument separation, and minimize damage to said documents being fed into said machine.

20. The document feeder of claim 17, wherein said control receives a signal indicating the feed rate of said documents and controls said separator surface motive element and said feed surface motive element to optimize the document feed rate, optimize interdocument separation, and minimize damage to said documents being fed into said machine.

21. The document feeder of claim 17, wherein said control receives a signal indicating the feed rate, condition and type of said documents and controls said separator surface motive element and said feed surface motive element to optimize the document feed rate, optimize interdocument separation, and minimize damage to said documents being fed into said machine.

22. The document feeder of claim 17, wherein said control is adapted to independently control the activation and speed of said feeder surface motive element and said separator surface motive element so that they work in concert to optimize the document feed rate, optimize interdocument separation, and minimize damage to said documents being fed into said machine.

23. The document feeder of claim 22, wherein said control receives a signal indicating the thickness of said document and controls both said feeder surface motive element and said separator surface motive element in concert to optimize the document feed rate, optimize interdocument separation, and minimize damage to said documents being fed into said machine.

24. The document feeder of claim 22, wherein said control receives a signal indicating the length of said document and controls both said feeder surface motive element and said separator surface motive element in concert to optimize the document feed rate, optimize interdocument separation, and minimize damage to said documents being fed into said machine.

25. The document feeder of claim 22, wherein said control receives a signal indicating the feed rate of said document and controls both said feeder surface motive element and said separator surface motive element in concert to optimize the document feed rate, optimize interdocument separation, and minimize damage to said documents being fed into said machine.

* * * * *